US007408518B2

(12) United States Patent
Minard et al.

(10) Patent No.: US 7,408,518 B2
(45) Date of Patent: Aug. 5, 2008

(54) RADIATING SLIT ANTENNA SYSTEM

(75) Inventors: Philippe Minard, Saint Medard sur Ille (FR); Ali Louzir, Rennes (FR); Bernard Denis, Saint Senoux (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/552,834

(22) PCT Filed: Apr. 1, 2004

(86) PCT No.: PCT/EP2004/003468

§ 371 (c)(1),
(2), (4) Date: Sep. 18, 2006

(87) PCT Pub. No.: WO2004/093250

PCT Pub. Date: Oct. 28, 2004

(65) Prior Publication Data

US 2007/0171140 A1 Jul. 26, 2007

(30) Foreign Application Priority Data

Apr. 15, 2003 (FR) ..... 03 04682

(51) Int. Cl.
*H01Q 13/10* (2006.01)

(52) U.S. Cl. ..... 343/770; 343/700 MS

(58) Field of Classification Search ..... 343/767, 343/770, 700 MS, 729
See application file for complete search history.

(56) References Cited

U.S. PATENT DOCUMENTS

| | | | | |
|---|---|---|---|---|
| 5,657,028 | A * | 8/1997 | Sanad | 343/700 MS |
| 6,043,785 | A * | 3/2000 | Marino | 343/767 |
| 6,239,761 | B1 * | 5/2001 | Guo et al. | 343/767 |
| 6,525,696 | B2 * | 2/2003 | Powell et al. | 343/770 |
| 6,657,600 | B2 * | 12/2003 | Thudor et al. | 343/770 |
| 6,724,346 | B2 * | 4/2004 | Le Bolzer et al. | 343/700 MS |
| 2002/0021250 | A1 | 2/2002 | Asano et al. | |
| 2004/0113841 | A1 | 6/2004 | Louzir et al. | |

FOREIGN PATENT DOCUMENTS

| | | |
|---|---|---|
| EP | 0685901 | 12/1995 |
| EP | 1291969 | 3/2003 |
| FR | 2821503 | 8/2002 |
| GB | 2328748 | 3/1999 |
| WO | WO 01/52353 | 7/2001 |
| WO | WO 03/058759 | 7/2002 |

OTHER PUBLICATIONS

Search Report Dated Jul. 15, 2004.

* cited by examiner

*Primary Examiner*—Tan Ho
(74) *Attorney, Agent, or Firm*—Joseph J. Laks; Robert D. Shedd; Brian J. Cromarty

(57) ABSTRACT

The invention relates to an antenna system comprising a first type of antenna and second and third antennas of a second type. The first to third antennas are slots which are excited by longitudinal radiation and are placed on the same edge of the same substrate. The first antenna is placed between the second and third antennas. This system is particularly suitable for integration in a PCMCIA card.

8 Claims, 3 Drawing Sheets

RADIATING SLIT ANTENNA SYSTEM

The invention relates to an antenna system and more particularly to antennas with longitudinal radiation.

Within the framework of IEEE802.11a or Hiperlan2 standard wireless networks operating at 5 GHz, it is envisaged to connect a laptop computer. Using a PCMCIA port has the advantage of offering a compact interface. For a PCMCIA interface, it is judicious to place the antenna at the extremity of the card so that it is clear of any obstacle to be able to radiate correctly.

The format of the PCMCIA card will give rise to constraints on the antenna located at the extremity of this card. FIG. 1 shows a PCMCIA card whose width $L_w$ equals 54 mm and length $L_i$ entering the drive is in the order of 83.3 mm. In order to maintain the compact character of a laptop computer, the antenna part protruding from the drive must be as compact as possible. Hence, one constraint on the antenna of such an interface is to have a width that does not exceed the width $L_w$ of the PCMCIA card, and a length $L_e$ that is as short as possible. Moreover, it is preferable that the thickness E of the card unit corresponds to a standardised thickness, equal to 5 mm for wireless extensions.

The compactness constraint of the antenna system is relatively high as such a system must integrate a antennas diversity of the order of 2 in reception and feature separate accesses for transmission and reception. The antennas must operate over the widest possible frequency band. The antennas must radiate chiefly away from the card so as to reduce the interaction with the computer comprising the PCMCIA drive.

To date, there is no solution for an antenna system meeting these constraints.

The invention proposes a longitudinal radiation antenna system in which the transmission and reception antennas alternate.

The invention is an antenna system comprising a first type of antenna and second and third antennas of a second type. The first to third antennas are slots which are excited by longitudinal radiation and are placed on the same edge of the same substrate. The first antenna is placed between the second and third antennas.

Preferentially, the first antenna is a transmission antenna and the second and third antennas are reception antennas. The first antenna is offset with respect to the second and third antennas so that the radiating extremity of the first antenna extends beyond the radiating extremities of the second and third antennas, the radiating extremity of the first antenna being located in the radiating zones of the second and third antennas.

In order to obtain a common access for the second and third antennas without introducing any losses, the feed lines of the second and third antennas constitute a single microstrip line. The microstrip line constituting the feed lines of the slots of the second and third antennas crosses the slot of the first antenna. The cross point is located on the microstrip line at a distance from one extremity of the said line equal to or in the order of a multiple of half the guided wavelength in the microstrip line. The cross point is located on the slot at a distance from a closed extremity of the said slot equal to or in the order of a multiple of half the guided wavelength in the slot. The extremities of the slots of the second and third antennas, being located opposite the radiating extremity, open out onto a break in the ground plane on which they are drawn, forming an open circuit at this extremity. The break in the ground plane can be short-circuited by using a diode.

The invention is also a PCMCIA standard card that includes the antenna system.

The invention will be better understood, and other specific features and advantages will emerge from reading the following description, the description making reference to the annexed drawings wherein.

In the following description and in the figures, the same references are used for the same elements.

Figure 1:
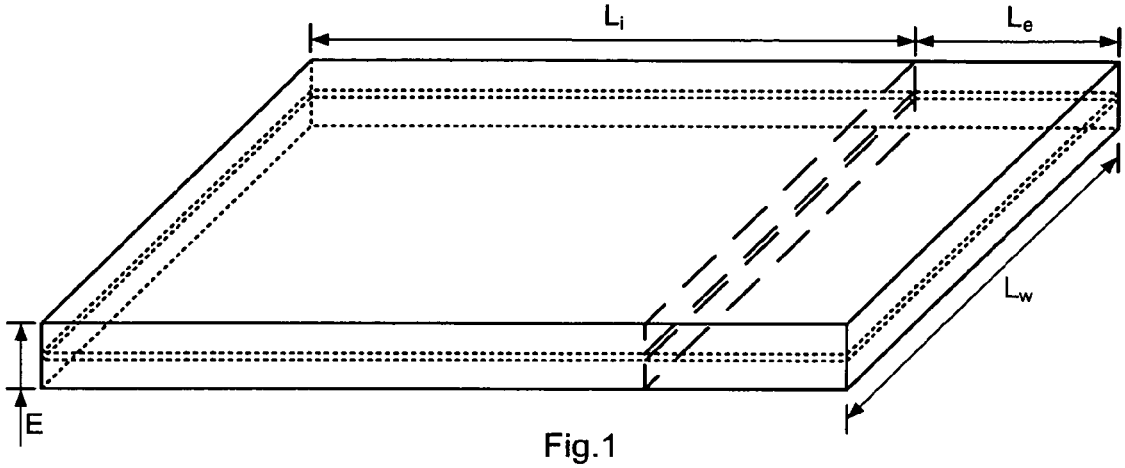
FIG. 1 shows a PCMCIA standard card
Figure 2:
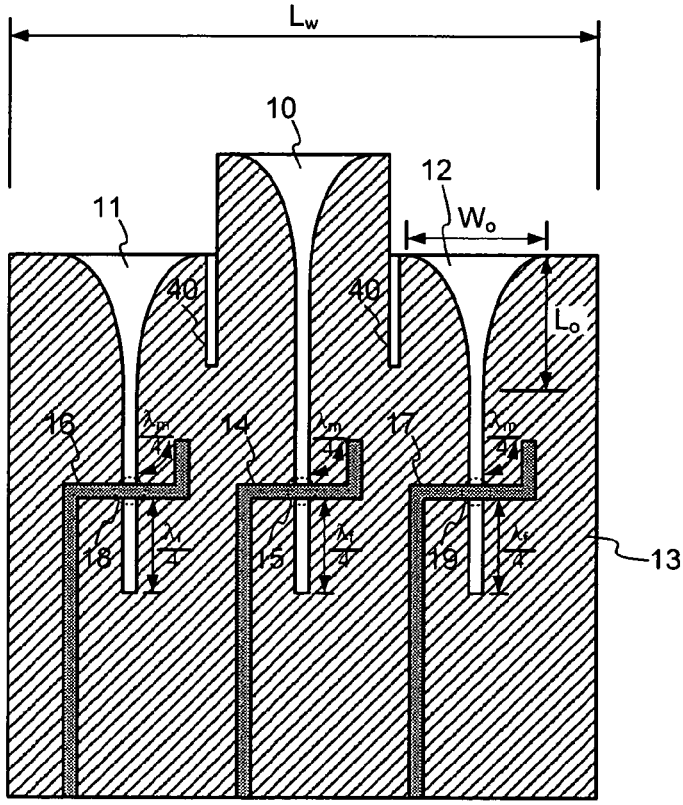
FIGS. 2 to 6 show different embodiments of an antenna system for a PCMCIA card according to the invention.

FIG. 2 shows a first embodiment of a slot antenna system placed at the extremity of a PCMCIA card. In order to simplify the description, only the antenna part of the PCMCIA card will be described. The transmission reception electronic device connected to the said antennas is for example a system operating according to the IEEE802.11a standard or according to the Hiperlan2 standard, that uses separate transmission and reception accesses with an antenna diversity of the order of 2 in reception. The frequency ranges used for the standards considered are listed in the following table:

TABLE A

| Technology | Application | Frequency band (GHz) |
|---|---|---|
| Europe BRAN/ HIPERLAN2 | Domestic networks | (5.15-5.35) (5.47-5.725) |
| US-IEEE 802.11a | Domestic networks | (5.15-5.35) (5.725-5.825) |

A first antenna 10 is used for transmission and a second and third antenna 11 and 12 are used for reception. The first to third antennas 10 to 12 are longitudinal radiation slot type antennas, for example Vivaldi type antennas, etched on a ground plane 13. The slots 10 to 12 are perpendicular to the outer edge of the substrate corresponding to the outer width of the PCMCIA card. To obtain a different antenna diversity, one variant is that slots 10 to 12 do not need to be perpendicular to this outer edge of the substrate, while keeping their opening on this same edge.

The dimension of the slots is determined to correspond to the required frequency bands according to a known technique. For example, the slots are 400 μm wide at the non-tapered part. Each slot 10 to 12 comprises a tapered opening placed at the edge of the ground plane 13 and a short-circuit end placed within the ground plane 13. The tapered openings are dimensioned as shown in the U.S. Pat. No. 6,246,377. For example, the tapered opening has a length $L_o$ equal to 12 mm and a width $W_o$ equal to 8 mm. The spacing of the radiating openings of the second and third slots 11 and 12 is such that the diversity of reception antennas can be obtained; they are separated by more than half the average wavelength of the transmission frequency band. The first longitudinal radiation slot 10 is offset with respect to the second and third longitudinal radiation slots 11 and 12 such that the radiating extremity of the first slot 10 extends beyond the radiating extremities of the second and third slots 11 and 12. The radiating extremity of the first slot 10 is located within the radiating zones of the second and third slots 11 and 12. A notch 40 forming a demetallization of the ground plane 13 is placed between the first slot 10 and the second slot 11 as well as between the first slot 10 and the third slot 12. Such an arrangement of slots and notches enables excellent insulation to be obtained. The first longitudinal radiation slot 10 does not have to be offset with respect to the second and third longitudinal radiation slots 11 and 12. This changes nothing in the operation of the antenna system.

A first microstrip line 14 is coupled to the first slot 10 by a Knorr type transition 15. Transition 15 is situated at a distance from the end of the microstrip line equal to or in the order of an odd multiple of the quarter of the guided wavelength $\lambda_m$ in the microstrip line, and at a distance from the end of the slot equal to or in the order of an odd multiple of a quarter of the guided wavelength $\lambda_f$ in the slot. The second and third microstrip lines 16 and 17 are respectively coupled to the second and third slots 11 and 12 by the Knorr type transitions 18 and 19. Transitions 18 and 19 are situated at a distance from the end of the microstrip lines 16 and 17 equal to or in the order of an odd multiple of the quarter of the guided wavelength $\lambda_m$ in the microstrip line, and at a distance from the end of the slots 11 and 12 equal to or in the order of an odd multiple of a quarter of the guided wavelength $\lambda_f$ in the slots. The microstrip lines are dimensioned according to a standard technique in order to enable signals in the frequency bands listed in table A to pass. For example, the microstrip lines 14, 16 and 17 are 520 μm wide. The microstrip lines constitute the accesses of the antennas-slots, also known as antenna feeder lines.

To minimise the size of the PCMCIA card, only the radiating parts can be located in the part of the card that lies outside of the card drive. However, the tapered openings must be slightly distanced from the card driver to prevent any disturbance in the antenna radiations. The slot lengths between the transitions and the radiation zone must be set according to what is required, knowing that this length can be null.

The system described above is a good solution for integrating antennas suitable for the required standards. This system has two reception accesses to obtain diversity. Nevertheless, it is preferable to have a single reception access so as to prevent any duplication of reception components (amplifiers, filters, transposition means). For this purpose, FIG. 3 proposes a variant using a switch 20 to switch the second and third microstrip lines 16 and 17 on a common microstrip line 21. The switch 20 is a microwave switch of a known type that comprises a control means not shown and that will not be described in further detail.

The first microstrip line 14 is separated into two microstrip lines 14 and 14*b* so as to cross the second microstrip line 16. The link between the two microstrip lines 14 and 14*b* is made by a coplanar line 22 connected by two transitions 23 and 24.

Figure 4:
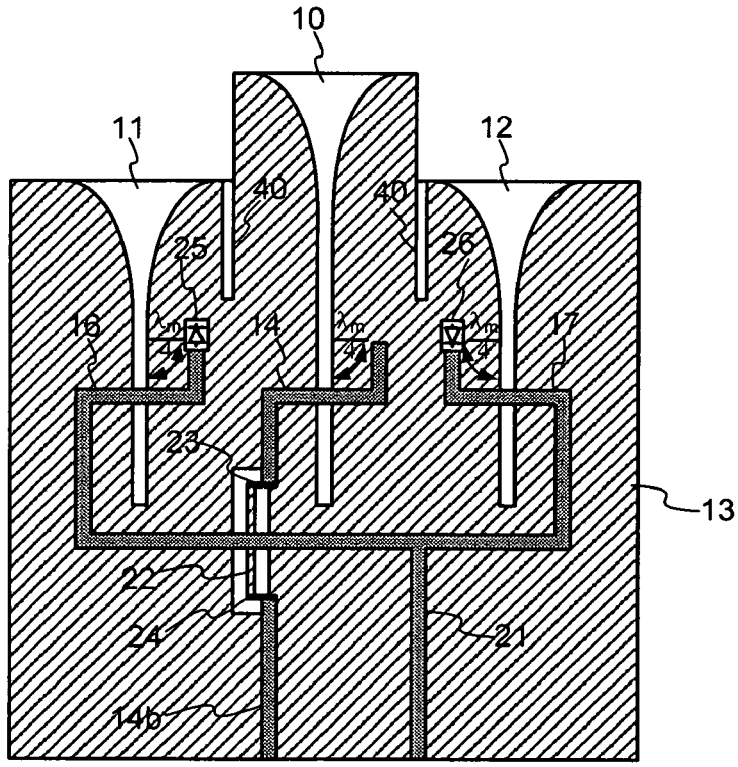

The use of the switch 20 results in an attenuation of the signal that must be compensated. In order to avoid this compensation, FIG. 4 shows another variant in which the second and third microstrip lines are connected directly to the common microstrip line 21. The switching of the second and third antennas 11 and 12 is carried out by two diodes 25 and 26 connected, on the one hand, respectively to the end of the second and third microstrip lines 16 and 17, and on the other by the ground plane 13. The diodes 25 and 26 are connected such that one is conducting and the other non-conducting when the second and third microstrip lines 16 and 17 are polarised with either a positive or negative voltage. When a diode 25 or 26 is non-conducting, it open circuits the end of the microstrip line 16 or 17 that is associated with it and thus ensures the coupling of the said line and the associated slot. When a diode 25 or 26 is conducting, it short circuits the microstrip line 16 or 17 that is associated with it with the ground plane for the high frequencies and there is no longer coupling between the said line and the associated slot. The reception antenna is selected only by a simple polarisation of the common microstrip line 21.

Figure 3:
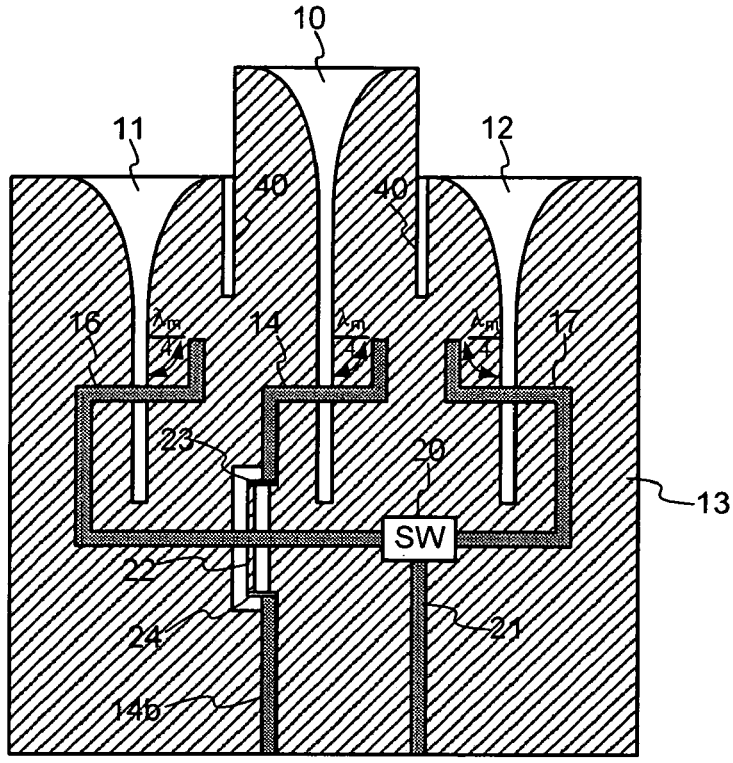
Figure 5:
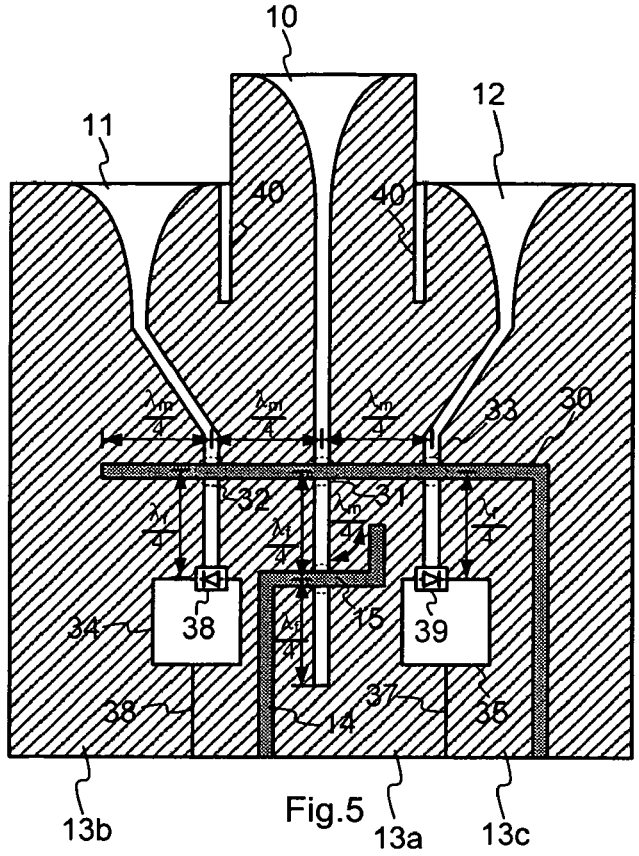

The embodiments of FIGS. 3 and 4 however both use the transitions 23 and 24 between the microstrip lines 14 and 14*b* and the coplanar line 22. These two transitions 23 and 24 also produce a signal attenuation. The variant of FIG. 5 is proposed in order to remove the attenuation related to the transitions 23 and 24 while also deleting the attenuation related to a switch 20 and while using a. single access for both reception antennas.

The access to the second and third slots 11 and 12 is here realized using a common microstrip line 30 that crosses the first to third slots 10, 11 and 12 respectively to the first to third intersections 31, 32 and 33. Two neighbouring intersections are separated from each other by an odd multiple distance of the quarter of the guided wavelength $\lambda_m$ in the said line. The intersection 32 closest to the extremity of the common line 30 is also located at a distance from the said extremity equal to or in the order of an odd multiple of the quarter of the guided wavelength $\lambda_m$ in the said line. The distance between the end of the first slot 10 and the first intersection 31 is equal to or in the order of a multiple of half the guided wavelength $\lambda_f$ in the said slot.

As the distances, on the one hand between the first intersection 31 and the end of the first slot 10, and on the other hand between the first intersection 31 and the extremity of the common microstrip line 30, are still multiples of half of the guided wavelength $\lambda_m$ or $\lambda_f$ in the said line or the said slot, there can be no coupling between the first slot 10 and the common microstrip line 30.

The extremity of each of the second and third slots 11 and 12 that is situated opposite the radiating zone gives onto respectively in a cavity 34 and 35 realised in the ground plane 13. Each cavity 34 or 35 corresponds to an open circuit with respect to the slot at this extremity. This cavity can particularly be square in shape, for example of dimensions (10 mm×10 mm), rectangular, polygonal, circular or even similar to a radial stub. The distance between the extremities of the second and third slots 11 and 12 located at the edge of the cavities 35 and 36 and respectively the second and third intersections 32 and 33 is equal to or in the order of an odd multiple of the quarter of the guided wavelength $\lambda_f$ in the said slots.

The ground plane 13 is separated into three parts 13*a*, 13*b* and 13*c* by break lines 36 and 37 that open out respectively in the cavities 36 and 37. The break lines are very fine notches, for example of a width of around 150 μm of the ground plane 13 that behaves like an open circuit with respect to direct current and like a short-circuit to the frequency bands used for the transmission. Two diodes 38 and 39 are placed at the limit between the second and third slots 11 and 12 and respectively the cavities 34 and 35.

The external parts 13*b* and 13*c* of the ground plane 13 are electrically connected to the electrical ground, that is to a DC voltage that can be either negative or positive. In the first case, the central part 13a is linked to a DC voltage that is either negative or positive. In the second case, it is connected to the electrical ground. The diodes 38 and 39 are connected between the central part 13*a* and each of the external parts 13*b* and 13*c* of the ground plane 13 and oriented so that when one of the diodes is conducting, the other is non-conducting. Hence, irrespective of the voltage of the central part 13*a* of the ground plane 13, there is always a conducting diode and a non-conducting diode.

When a diode 38 or 39 is non-conducting, it produces a short-circuit at the extremity of the slot 11 or 12 that is associated with it. So there is a coupling between the slot 11 or 12 and the common line 30. When a diode 38 or 39 is non-conducting, a short-circuit plane is brought to the level of the intersection 32 or 33 and no coupling is produced between the slot 11 or 12 and the common line 30. The selection is made by a simple polarisation either of the central part 13*a* of the ground plan 13, or of the external parts 13*b* and 13*c* of the ground plan 13.

Figure 6:
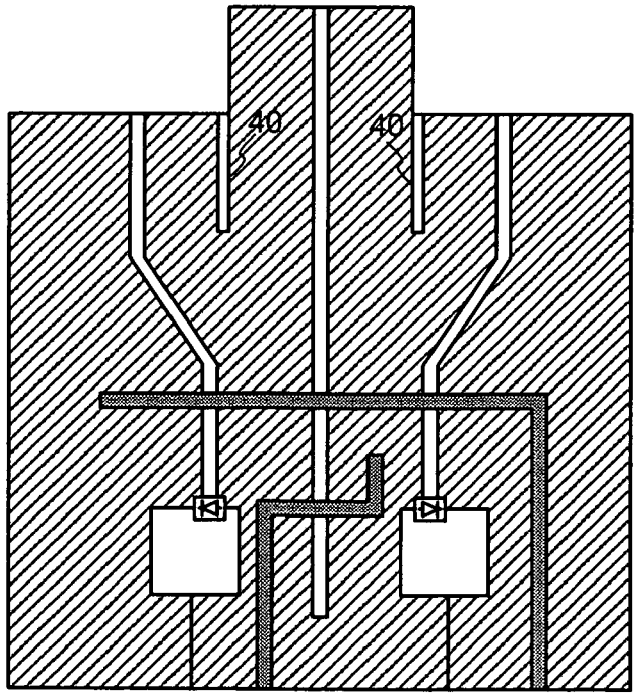

Other variants are possible. The Vivaldi antennas can be replaced by any other type of antenna fed by a line/slot transition (of the printed dipole type, tapered slot antenna, etc.), or a system of antennas as shown in FIG. 6 that uses simple slots.

Also, the embodiments described above show the reception antenna diversity. It is entirely conceivable to obtain transmission antenna diversity. In this case, the reception antenna will be placed between the transmission antennas.

The invention claimed is:

1. An antenna system that comprises on a same substrate:

a first transmission antenna, and second and third reception antennas, the first to third antennas being slots which are excited by longitudinal radiation and are placed on a same edge of the same substrate, and the first antenna being placed between the second and third antennas, wherein the first antenna is offset with respect to the second and third antennas such that the radiating extremity of the first antenna extends beyond the radiating extremities of the second and third antennas, the radiating extremity of the first antenna being located in the radiating zones of the second and third antennas.

2. The system according to claim 1, wherein a notch in a ground plane of the substrate is placed between the first antenna and the second antenna as well as between the first antenna and the third antenna.

3. The system according to claim 1, wherein the slots are excited by feed lines constituted by microstrip lines.

4. The system according to claim 3, wherein the feed lines of the second and third antennas constitute a single microstrip line.

5. The system according to claim 4, wherein the microstrip line constituting the feed lines of the slots of the second and third antennas crosses the slot of the first antenna, the crossing point being situated on the microstrip line at a distance, from the extremity of the said line, in the order of an odd multiple of half the guided wavelength ($\lambda_m$) in the microstrip line, and the crossing paint being situated on the slot at a distance from a closed extremity of the said slot in the order of an odd multiple of half the guided wavelength ($\lambda_f$) in the slot.

6. The system according to claim 5, wherein the extremities of the slots of the second and third antennas, being situated opposite the radiating extremity, open out onto a break in the ground plane on which they are drawn, the break of the ground plane being able to be short-circuited via a diode.

7. A PCMCIA standard interface card comprising an antenna system that comprises on a same substrate:

a first transmission antenna, and second and third reception antennas, the first to third antennas being slots which are excited by longitudinal radiation and are placed on a same edge of the same substrate, the first antenna being placed between the second and third antennas, wherein the first antenna is offset with respect to the second and third antennas such that the radiating extremity of the first antenna extends beyond the radiating extremities of the second and third antennas, the radiating extremity of the first antenna being located in the radiating zones of the second and third antennas.

8. The card according to claim 7, wherein the antenna system is placed at the end of the card in a zone placed outside a card drive.

* * * * *